US008263868B2

(12) United States Patent
Konz

(10) Patent No.: US 8,263,868 B2
(45) Date of Patent: Sep. 11, 2012

(54) DEVICE FOR ABSORPTION OF NOISE

(75) Inventor: Oliver Konz, Ilshofen (DE)

(73) Assignee: Wuerth Elektronik eiSos GmbH & Co. KG, Waldenburg (DE)

( * ) Notice: Subject to any disclaimer, the term of this patent is extended or adjusted under 35 U.S.C. 154(b) by 212 days.

(21) Appl. No.: 12/303,593

(22) PCT Filed: May 31, 2007

(86) PCT No.: PCT/EP2007/004808

§ 371 (c)(1),
(2), (4) Date: Jan. 30, 2009

(87) PCT Pub. No.: WO2007/140918

PCT Pub. Date: Dec. 13, 2007

(65) Prior Publication Data

US 2010/0170712 A1 Jul. 8, 2010

(30) Foreign Application Priority Data

Jun. 8, 2006 (DE) ..... 10 2006 027 312

(51) Int. Cl.
*H01R 4/70* (2006.01)

(52) U.S. Cl. ..... 174/138 F; 336/92

(58) Field of Classification Search ..... 174/138 F; 336/92, 174

See application file for complete search history.

(56) References Cited

U.S. PATENT DOCUMENTS

| | | | | |
|---|---|---|---|---|
| 3,183,302 | A * | 5/1965 | Wochner al. | 174/138 F |
| 3,278,674 | A | 10/1966 | Matthysse et al. | |
| 3,462,715 | A | 8/1969 | Schor | |
| 3,484,541 | A | 12/1969 | Campbell | |
| 4,505,006 | A | 3/1985 | Andre | |
| 4,644,610 | A | 2/1987 | Fish | |
| 5,003,278 | A | 3/1991 | May | |
| 5,162,772 | A * | 11/1992 | May | 336/92 |
| 5,374,017 | A | 12/1994 | Martin et al. | |
| 5,900,796 | A | 5/1999 | Parker | |
| 6,111,201 | A | 8/2000 | Drane et al. | |
| 6,259,346 | B1 | 7/2001 | Nakano | |
| 6,335,672 | B1 * | 1/2002 | Tumlin et al. | 336/175 |
| 6,437,678 | B1 | 8/2002 | Konz | |
| 6,559,748 | B1 | 5/2003 | Nakano | |
| 7,044,761 | B2 * | 5/2006 | Sokol et al. | 439/263 |
| 2002/0180163 | A1 | 12/2002 | Muller et al. | |
| 2006/0011372 | A1 | 1/2006 | Rodrigues et al. | |
| 2007/0099503 | A1 | 5/2007 | Konz | |

FOREIGN PATENT DOCUMENTS

| | | | |
|---|---|---|---|
| CN | 1571216 | A | 1/2005 |
| JP | 3268397 | A | 11/1991 |
| SU | 1550087 | A1 | 3/1990 |

* cited by examiner

*Primary Examiner* — Hung Ngo

(74) *Attorney, Agent, or Firm* — Boyle Fredrickson, S.C.

(57) ABSTRACT

A device for absorbing the electrical noise in cables contains a housing with a feed-through for a cable, which in the fastened position projects out of both end-faces of the housing. Externally on each of the end faces there are two strips which between them form a slot, and these strips form fixing edges bounding the slot The strips are connected to the end-faces of the housing in such a way that they are able to turn away from one another, so that their fixing edges can be moved further away or nearer along the longitudinal direction of the cable. By this means the breadth of the slot can be adapted to the flexibility and/or the diameter of the cable.

7 Claims, 2 Drawing Sheets

DEVICE FOR ABSORPTION OF NOISE

Figure 1:
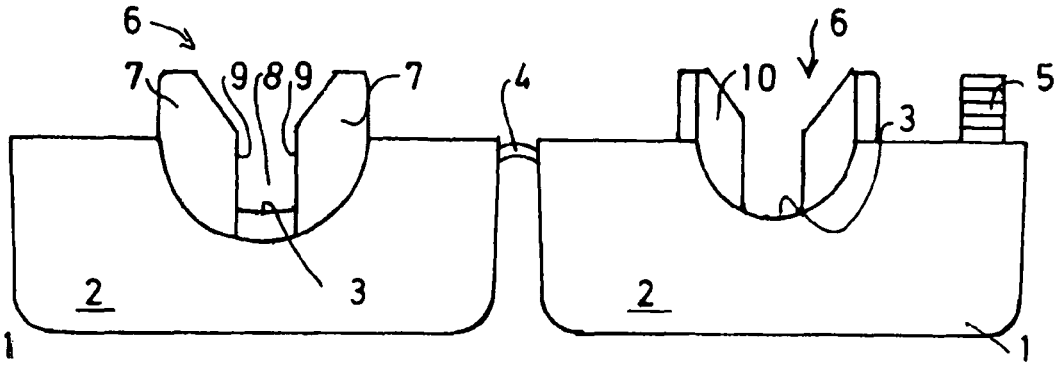

The invention relates to a device for absorbing electrical noise on cables.

It is known that the propagation of interfering electrical signals, which are also termed "noise," in cables may be prevented by routing the cables through either a fully closed, or a nearly fully closed, ring fabricated from for example ferromagnetic material. In order to also be able to subsequently route existing cables through such rings, devices where a pair of half-rings fabricated from ferromagnetic are incorporated in a split-shell housing are known. This housing is then closed around a cable, yielding a closed magnetic ring, or a ring having a narrow air gap. In order to be able to fasten such devices to the cable, the housings have a fixing means. It should be prevented that the housing containing the ferromagnetic material slides along the cable. For example, it is known to form teeth that grip the cable on an aperture, through which the cable is channelled. In a known device of this type (cf. EP 257179), several such teeth are configured in each aperture.

It is also known to insert the cable in a slot between two edges and to clamp it in place (cf. DE 19912917).

Devices of this type are frequently attached to cables with various diameters. However, there is also the problem that cables with the same gauge may have differing flexibilities. This applies for example when cables have heavy-gauge, wire cores. In this case, they are less flexible than cables with numerous, thin, wire cores.

The invention is based on the task of designing a device for absorbing electrical noise in cables which can be securely attached to various types of cables.

In order to solve this task, the invention proposes a device with the features mentioned in claim 1. Further developments of the invention are subject of the subsidiary claims.

The device thus comprises a housing, in which the ferromagnetic material is accommodated. The housing can be a split-shell housing similar to those known from the state of the art. However, the invention is also applicable to housings that are not configured in the form of a pair of half-shells, and where cables must, for example, be channelled through them. The deformation of the fixation means along the length of the cable makes it possible to accommodate very stiff or very thick cables in order to develop, sufficient reactive forces through deformation which serves for fixation. The stiffer a cable is, the more space is also available on the end walls, since the cable cannot be bent there.

In further development of the invention, it can be provided that the fixation means is designed deformable in the direction transverse to the cable. An additional possibility for accommodating cables having differing flexibilities and/or gauges.

In further development of the invention, it can be provided that the fixation means has a pair of fixing edges forming a slot, between which the cable may be fixed. This can be accomplished wither by pressing the cables into the slot from the side and then fixed in this manner. Due to the longitudinal deformation it is however also possible that the cable is slid through the fixation means from one side, which then also leads to deformation of the fixation means.

In further development of the invention, it can also be provided that the fixing edges are formed on trips which run roughly parallel to the ends of the housing. The strips can be flat plate-like components. These are connected to the ends of the housing at certain locations.

For example, in further development of the invention, it can be provided that the strips have L-shaped cross-sections, whereby one leg is parallel to the end of the housing and comprises the fixing edge.

The other leg is preferably an integral part of the end wall of the housing.

In the case of a slot open on one side, it can be provided according to the invention that the outer ends of the fixing edges diverge from one another, proceeding toward the free end of the slot.

It can be provided that the fixing edges are parallel to one another in the vicinity of a closed end of the slot.

According to the invention, it can be provided that fixation means which are preferably identical to the other fixation means are provided on the opposite end of the housing.

Figure 2:
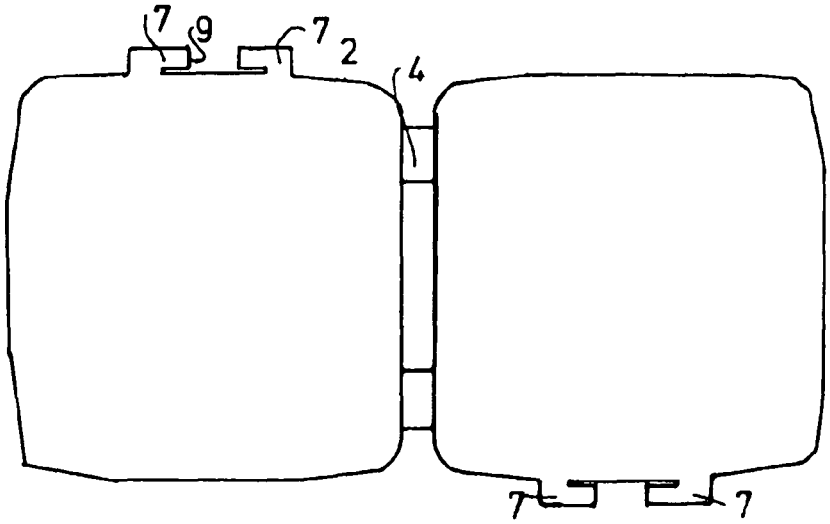
Figure 5:
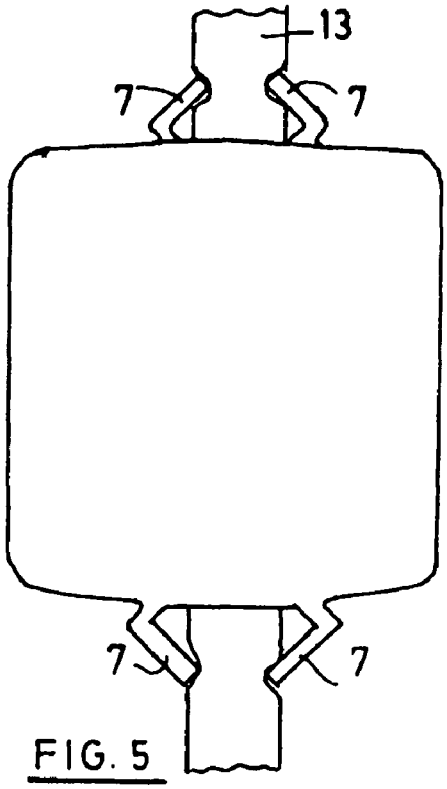
Figure 4:
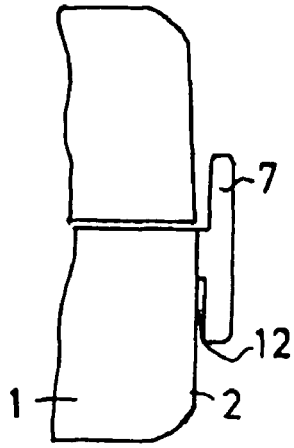
Figure 3:
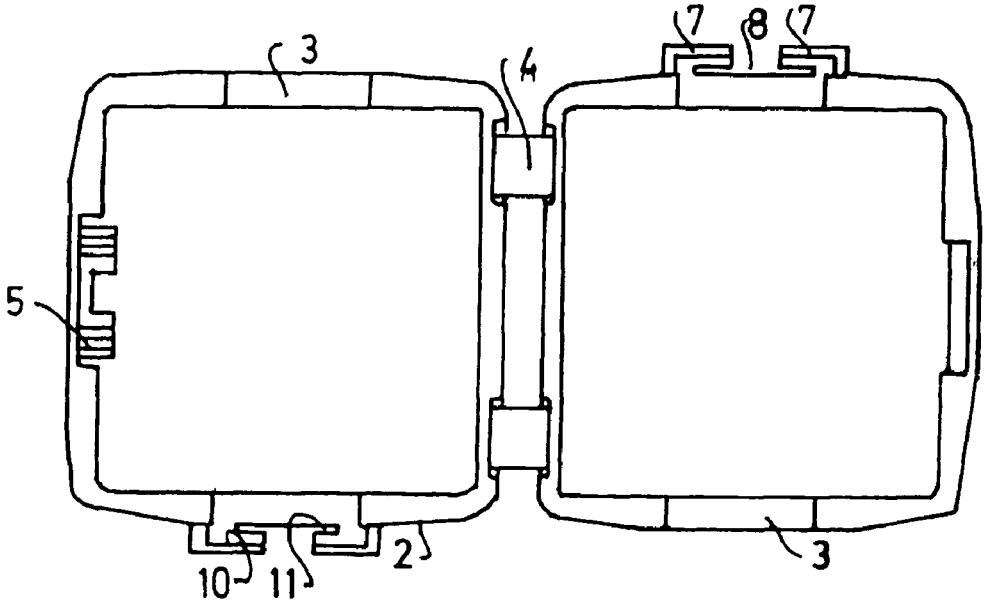

Other features, details, and advantages of the invention are evident from the claims and the abstract, both of whose wordings are herewith made an integral part of this description by way of reference thereto, the following descriptions of preferred embodiments of the invention, and the drawings, which depict:

FIG. 1: an end view of an opened housing;

FIG. 2: a view of the opened housing from the closed side of both housing shells;

FIG. 3: a top view of the opened housing shown in FIG. 1;

FIG. 4: a side view of the closed housing, without cable;

FIG. 5: a schematised, top view of the housing fixed onto a heavy-gauge cable.

FIG. 1 depicts an end view of an opened housing of a device for absorbing electrical noise in cables. The housing comprises a pair of half-shells 1 that are roughly trough formed and each end 2 of which has a roughly semicircular notch 3. The pair of half-shells 1 are joined together by a foil hinge 4 formed in the vicinities of their long edges. On the outer edge of one half-shell opposite the foil hinge 4, there is a protrusion 5 with teeth that latch the half-shells 1 in place in the closed position.

A fixation means 6 that, in particular, is injection-moulded onto the plastic of the housing, is configured in the vicinity of the end 2 of the left-hand housing shell visible in FIG. 1. The fixation means 6 comprises two strips 7 that have planar, front surfaces running parallel to the end 2 of the associated housing half-shell 1. Both strips have a gap between them forming a slot 8. The inner surfaces of the strips 7 form fixing edges 9. In the lower area of FIG. 1 where the end of the slot 8 formed by the contour of the semicircular notch 3 in the end 2 of the housing is situated, the fixing edges run parallel to one another. The fixing edges diverge in order to form an insertion channel in the vicinity of the end of the slot 8 where it is open.

An identical fixation means 6 is arranged on the opposite end of the second housing half-shell 1, on the right in FIG. 1. In this case, the rear surfaces 10 of the strips 7, which form a step are shown, since they have a distance from the ends 2 of the housing half-shells 1.

FIG. 2 depicts a view of the housing half-shells from below in FIG. 1. It can be seen that a pair of foil hinges 4 separated by a distance are present. It can also be seen that the strips 7 have L-shaped cross-sections, or are L-shaped when viewed from below, whereby one leg of each strip 7 runs parallel to the end 2 of the housing. The second leg serves to join the first leg with the end 2 of the housing in a single piece. As can also be seen from FIG. 2, exertion of a longitudinal stress, i.e., a stress acting from bottom to top in FIG. 2, allows the fixing edges 9 to move upward, due to deformation of the strips 7.

Turning to FIG. 3. This shows the arrangement of FIG. 1, as viewed from above in FIG. 1. Here it can be seen that the rear surfaces 10 of the strips 7 are a distance away from the surfaces of the ends 2 and that the notches, or incisions 11, that allow the strips 7 to deform longitudinally along the length of the cable are present between the strips and the ends 2 of the housing half-shells.

FIG. 4 depicts a side view of the closed housing, without inserted cable. Also in this view, an incision 12 is present between the strips 7 and the ends 2 of the housing half-shells 1 in order to reduce the height of the legs connecting the strips 7 with the housing. This also contributes to arranging the strips 7, which is configured in the form of plate-like components, so that it can be deformed by deforming the connection elements in such a manner that the fixing edges 9 can move in the axial direction. "Axial direction" is defined as along the axis linking the semicircular notches 3 on either end of a housing half-shell.

The result of attaching such a housing to a cable 13 is depicted in FIG. 5. It is assumed that the cable involved is a relatively heavy-gauge cable whose diameter is significantly larger than the distance between the two fixing edges 9 at their parallel sections. This causes the strips 7 to pivot away from the ends 2 of the housing half-shells in order to widen the slot 8. Simultaneously, the effect occurs that the corners of the fixing edges 9 form sharp edges that grip the insulating material of the cable 13. As can be seen from FIG. 5, this type of deformation also allows clamping stiff, heavy-gauge cables 13 while thin or flexible cables lead to less deformation of the strips 7.

The invention claimed is:

1. A device for absorbing electrical noise on cables having a housing wherein, in a closed state, the housing has an aperture on either end for accommodating a cable passing through the housing, and the housing further comprising a fixation means for fixing the housing on the cable, wherein the fixation means in the vicinity of the aperture grips the cable on at least one end and is designed to be deformable along a longitudinal axis of the cable, wherein the fixation means has a pair of fixing edges having straight portions forming a substantially rectangular slot between them in which the cable may be positioned and fixed when the housing is in an open state, and wherein the pair of fixing edges are deformable along the longitudinal axis of the cable and transversely to the cable.

2. A device according to claim 1, wherein the fixing edges are formed on strips which run roughly parallel to ends of the housing.

3. A device according to claim 2, wherein the strips have L-shaped cross-sections, whereby one leg of the strips runs parallel to the ends of the housing and the fixing edges.

4. A device according to claim 3, wherein the other leg is joined to one end of the housing as a single piece.

5. A device according to claim 1, wherein the fixing edges have outer ends which extend from the straight portions and which diverge away from one another.

6. A device according to claim 1, wherein the straight portions of the fixing edges run parallel to one another in an end area of the slot.

7. A device according to claim 1, wherein the fixation means is formed on both ends of the housing.

* * * * *